US006808254B2

(12) United States Patent
Sakaida et al.

(10) Patent No.: US 6,808,254 B2
(45) Date of Patent: Oct. 26, 2004

(54) INK JET PRINTER HEAD

(75) Inventors: Atsuo Sakaida, Gifu (JP); Atsushi Hirota, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 10 days.

(21) Appl. No.: 09/995,756

(22) Filed: Nov. 29, 2001

(65) Prior Publication Data

US 2002/0080215 A1 Jun. 27, 2002

(30) Foreign Application Priority Data

Nov. 30, 2000 (JP) ..... 2000-365067
Mar. 29, 2001 (JP) ..... 2001-096421

(51) Int. Cl.[7] ..... B41J 2/045
(52) U.S. Cl. ..... 347/71; 347/68
(58) Field of Search ..... 347/71, 20, 68–70, 347/40, 9, 72, 85; 29/25.35; 310/311, 324, 327, 333

(56) References Cited

U.S. PATENT DOCUMENTS

| | | | | |
|---|---|---|---|---|
| 4,680,595 A | | 7/1987 | Cruz-Uribe et al. | 347/40 |
| 5,087,930 A | | 2/1992 | Roy et al. | 347/85 |
| 5,402,159 A | | 3/1995 | Takahashi et al. | 347/9 |
| 6,033,058 A | * | 3/2000 | Usui et al. | 347/71 |
| 6,505,919 B1 | * | 1/2003 | Mizutani | 347/70 |
| 6,666,547 B1 | * | 12/2003 | Takahashi et al. | 347/70 |

FOREIGN PATENT DOCUMENTS

| | | |
|---|---|---|
| JP | A 62-111758 | 5/1987 |
| JP | B2 2-4429 | 1/1990 |
| JP | A 3-114654 | 5/1991 |
| JP | B2 7-67803 | 7/1995 |

* cited by examiner

*Primary Examiner*—K. Feggins
(74) *Attorney, Agent, or Firm*—Oliff & Berridge, PLC

(57) ABSTRACT

An ink jet printer head includes a cavity plate and an actuator with the following configuration. The cavity plate is formed with four columns of pressure chambers. Each pressure chamber has a parallelogram shape with two acute-angle portions formed with an ink supply opening and an ink ejection nozzle opening, respectively. The pressure chambers in the center two columns are arranged with the ejection-nozzle sides interposed between each other. The pressure chambers in the outer two columns are arranged with the ejection-nozzle sides interposed between ink-supply sides of the center two columns. The pressure chambers are arranged so that, although the pressure chambers are partially interposed between each other, the principal portion of each pressure chamber in one column is shifted out of alignment from principal portions of pressure chambers in adjacent columns with respect to the direction in which the long side of the pressure chambers extend. The actuator unit is disposed across the plurality of pressure chambers and includes a plurality of pressure generating portions at positions that correspond to the pressure chambers.

24 Claims, 12 Drawing Sheets

PRIOR ART

INK JET PRINTER HEAD

BACKGROUND OF THE INVENTION

1. Field of the Invention

The present invention relates to an ink jet printer head for printing by ejecting ink on a print medium and more particularly to an ink jet printer head including a cavity plate formed with parallelogram-shaped ink pressure chambers.

2. Description of the Related Art

U.S. Pat. No. 4,680,595 discloses an ink jet printer head with a laminated configuration forming a plurality of pressure chambers and an actuator unit spanning across the pressure chambers. The pressure chambers are arranged next to each other and each has an election nozzle, The actuator unit includes a plurality of piezoelectric elements disposed on a single diaphragm plate. The piezoelectric elements are arranged in a one-to-one correspondence with the pressure chambers.

Japanese Patent-Application Publication No. HEI-3-114654 discloses an ink jet recording head with a plurality of pressure chambers and a laminated piezoelectric actuator spanning across the pressure chambers. The pressure chambers are arranged mutually next to each other and each has an ejection nozzle. The actuator includes a plurality of electrodes arranged in a one-to-one correspondence with the pressure chambers. Ink is ejected from the nozzles by applying a voltage to one of the piezoelectric elements so that the portion of the actuator that corresponds to the pressure chamber deforms to protrude or retract in order to apply pressure to the ink in the corresponding pressure chamber. The ink in the pressure chamber is ejected out through the nozzle by the pressure.

U.S. Pat. No. 5,402,159 discloses an ejector array made up of an ink channel body and a laminated piezoelectric actuator. The ink channel body is formed with ink channels in a one-to-one correspondence with ink ejecting orifices. The actuator is fixedly secured to the ink channel body. The piezoelectric actuator is made up of piezoelectric ceramic layers, internal negative electrode layers shared by all the ink channels, and internal positive electrode segments aligned with corresponding ink channels. The piezoelectric actuator has piezoelectric active regions sandwiched between the internal negative layer and the internal positive electrode layer segments.

Japanese Examined-Patent-Application-Publication No. HEI2-4429 and U.S. Pat. No. 5,087,930 disclose ink jet printer heads with a cavity plate formed with lemon-shaped pressure chambers. The ink jet printer head of Japanese Examined-Patent-Application-Publication No. HEI-2-4429 includes a rectangular cavity plate formed with the pressure chambers aligned in two coaxial arc-shaped columns. Ink ejecting nozzles are positioned at the substantial axial center on the arc shapes. One acute-angled portion of each pressure chamber faces the ejection nozzles and is formed with an ink channel connected to one of the ejection nozzles. U.S. Pat. No. 5,087,930 discloses an ink jet printer head with two pressure chamber columns provided in a staggered arrangement for a single row of ink ejection nozzles. Pressure chamber in both columns have one acute-angled portion aligned with the row of ink ejection nozzles. Connecting passageways connect the acute-angled portions with the ink ejection nozzles.

SUMMARY OF THE INVENTION

U.S. Pat. No. 4,680,595 and in Japanese Patent-Application Publication No. HEI-3-114654 describe rectangular shaped pressure chambers aligned in parallel with each other with a single actuator spanning across all of the pressure chambers. As shown in FIG. 1, when an actuator 50 is positioned across a plurality of pressure chambers 51*a*, 51*b*, 51*c*, when the actuator 50 deforms at a portion 50*a* corresponding to one pressure chamber 51*a*, the actuator portions 50*b*, 50*c* that correspond to adjacent chambers 51*b*, 51*c* will deform in the opposite direction with partition walls 52*a*, 52*b* serving as fulcrums. This results in cross-talk, wherein undesirable fluctuations in pressure are inevitably generated in the ink in the adjacent pressure chambers 51*a*, 51*c* and when ink is again ejected from the same pressure chamber 51*a*, the fluctuations in pressure overlap so that a predetermined ink ejection cannot be obtained.

Although the ink jet printer heads disclosed in Japanese Examined-Patent-Application-Publication No. HEI-2-4429 and U.S. Pat. No. 5,087,930 achieve a compact size by using lemon-shaped ink pressure chambers, problems arise when the number of nozzles for ejecting ink is increased to produce a color ink jet head.

For example, it is impossible to concentrate the nozzle columns for ejecting ink. That is, the ink jet printer head disclosed in Japanese Examined-Patent-Application-Publication No. HEI-2-4429 has ejection nozzles that open to the same edge surface of the cavity plate, so the only way to increase the number of nozzles is to provide a plurality of cavity plates stacked on top of each other. The ink jet printer head disclosed in U.S. Pat. No. 5,087,930 requires a pair of pressure chamber columns for each row of nozzles, that is, for each different ink color. The different nozzle rows must be separated by two column's distance.

Also, the ink jet printer head must be attached with great precision. That is, ink droplets from corresponding nozzles of adjacent nozzle columns should impinge on that same position of the recording medium. However, when nozzle columns are greatly separated from each other, ink droplets from corresponding nozzles can impinge on the recording medium at different positions if the head is even slightly slanted with respect to a relative movement between the ink jet head and the recording medium.

When pressure chambers are aligned in the manner described in U.S. Pat. No. 5,087,930, the only way to increase the density of pressure chamber columns in the ink jet printer head is to shorten the distance from the ink supply opening to the nozzle connecting passageway of the pressure chambers. By doing this, pressure waves can propagate from one end of the pressure chamber to other in a much shorter time, and so the ink ejection cycle can be shortened. However, a certain amount of time is required from when voltage is first applied to drive a piezoelectric element to when the voltage reaches a predetermined voltage required to deform the piezoelectric element. This is termed the rising-edge time of the voltage. If rising-edge time of the voltage is longer than the time required for the pressure wave to propagate once across the pressure chamber, then the piezoelectric actuator cannot be driven efficiently, which defeats the benefit of making the pressure chamber shorter. Further, if the distance from the ink supply port and the ink ejection nozzles in the pressure chambers is shortened excessively in order to increase the density of pressure chamber columns, the actuators, such as piezoelectric elements, cannot deform into the pressure chambers by an amount sufficient to properly eject droplets.

The arrangements disclosed in Japanese Examined-Patent-Application-Publication No. HEI-2-4429 and U.S. Pat. No. 5,087,930 include pressure chambers that are adjacent to each other in the direction in which they are shifted to produce the staggered arrangement. These adjacent pressure chambers have broad edges in confrontation with each other. Cross talk is a problem with these arrangements because of these confronting edges.

It is an objective of the present invention to overcome the above-described problems and to provide an ink jet print head with a plurality of ink pressure chambers that correspond to a plurality of nozzles aligned in columns without increasing dimensions of the cavity plate.

It is another objective of the present invention to provide an ink jet printer head with reduced cross talk and stable predetermined ink ejection.

In order to achieve the above-described objectives, an ink jet printer head according to one aspect of the present invention includes a cavity plate and an actuator with the following configuration.

The cavity plate is formed with at least a first, second, and third column of pressure chambers. Each pressure chamber has a substantial parallelogram shape with two acute-angle portions. One acute-angle portion is formed with an ink supply opening. The other acute-angle portion is formed with an ink ejection nozzle opening. The pressure chambers in the first and second columns are arranged so that the ejection-nozzle-side acute-angle portions of chambers in one column are interposed between ejection-nozzle-side acute-angle portions of pressure chambers of the other column. The pressure chambers of the third column are arranged so that ejection-nozzle-side acute-angle portions are interposed between the ink-supply-side acute-angle portion of pressure chambers in either the first or second columns.

The actuator is disposed in confrontation with the pressure chambers of the cavity plate and applies ejection pressure to the ink in the ink pressure chambers.

Because the pressure chambers have substantially the shape of a parallelogram with acute angles, a large number of pressure chambers can be provided in the cavity plate without increasing the size of the cavity plate. When the pressure chambers of the first, second, and third columns are arranged with acute-angle portions interposed in this manner, the ink jet nozzles of the first or second columns can be positioned in close proximity to each other. The ink jet nozzles of the third column can be positioned much closer to the ink jet nozzles of the first and second columns than if the ink-supply-side acute-angle portions were interposed between the ink-supply-side acute-angle portions of pressure columns of the first or second column. Also, because the ink supply ports and the ink nozzle ports are provided in the opposing acute-angle portions formed in the parallelogram-shaped ink pressure chambers, even if the pressure chamber columns are provided at a high density, a suitable distance can be opened between the ink supply ports and the ink ejection nozzle ports. As a result, the drive waveform of the drive voltage can have a slower rising edge time and the actuator can deform by a sufficient amount.

An ink jet printer head according to a second aspect of the present invention includes a cavity plate and an actuator with the following configuration.

The cavity plate is formed with a plurality of pressure chambers, nozzles, and ink supply sources. Each pressure chamber is connected to a corresponding nozzle through one end of the pressure chamber and to a corresponding ink supply source through the other end of the pressure chamber. Each pressure chamber has a pair of confronting parallel side walls that define therebetween a principal portion. The pressure chambers are arranged so that parallel lines defined by the side walls of each pressure chamber are parallel with parallel lines defined by side walls of adjacent pressure chambers, and also so that the principal portions are shifted out of alignment with each other in a direction extending parallel with the side walls.

The actuator unit is disposed across the plurality of pressure chambers and includes a plurality of pressure generating portions at positions that correspond to the pressure chambers.

Because the principal portions are shifted out of alignment in this manner, cross talk can be prevented.

BRIEF DESCRIPTION OF THE DRAWINGS

The above and other objects, features and advantages of the invention will become more apparent from reading the following description of the embodiment taken in connection with the accompanying drawings in which.

DETAILED DESCRIPTION OF THE EMBODIMENTS

Next, ink jet printer heads according to embodiments of the present invention will be described while referring to the attached drawings.

Figure 2:
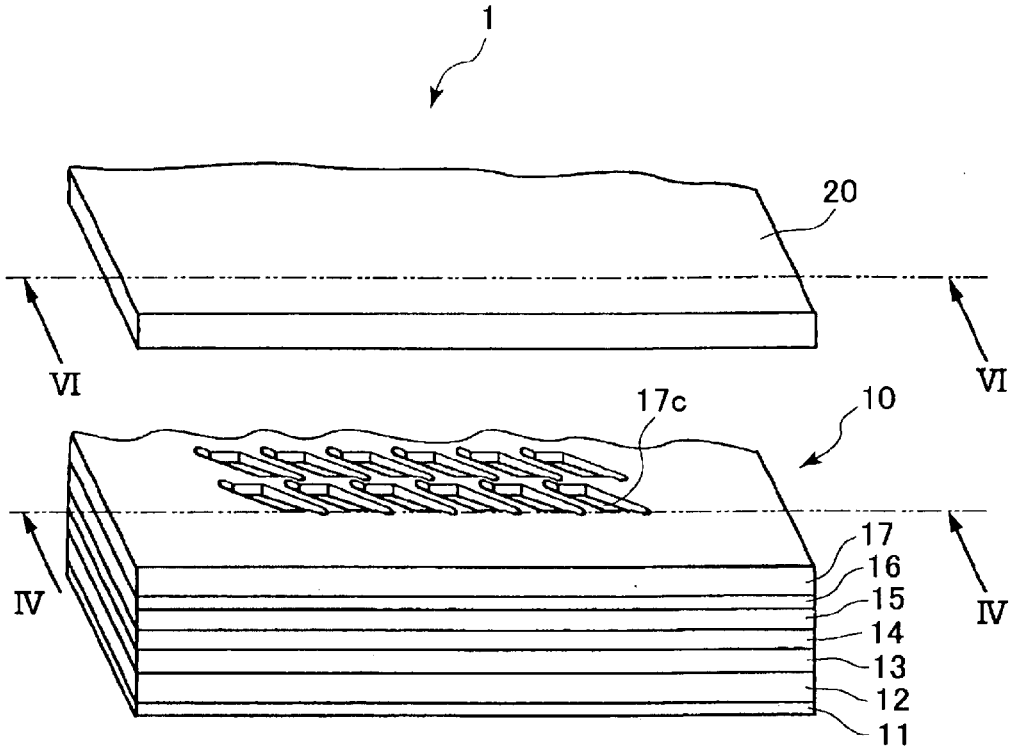
FIG. 2 is an exploded perspective view showing an ink jet printer head according to a first embodiment of the present invention.

First, an ink jet printer head 1 according to a first embodiment will be described while referring to FIGS. 2 to 9. As shown in FIG. 2, the ink jet printer head 1 includes a cavity plate 10 and a plate-shaped piezoelectric actuator 20. The cavity plate 10 is configured from laminated metal plates each having a rectangular shape. The actuator 20 is stacked on top of the cavity plate 10. The surface of the cavity plate 10 is formed with plural columns of ink pressure chambers 17*c*. Each ink pressure chamber 17*c* has a substantial parallelogram shape with two acute and two obtuse angled portions. This configuration enables providing a plurality of ink pressure chambers without increasing the size of the cavity plate 10.

Figure 3:
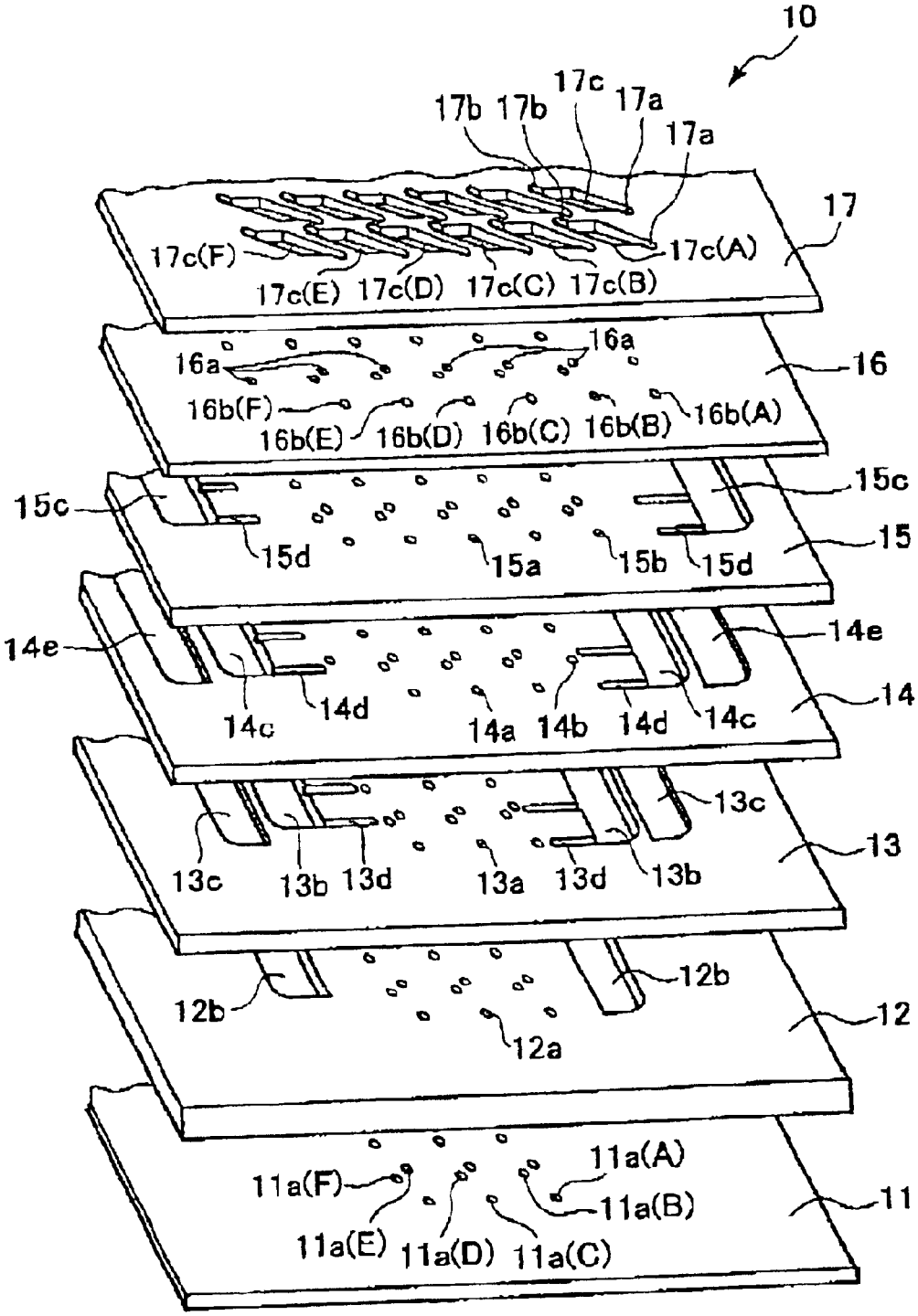
FIG. 3 is an exploded perspective view showing a cavity plate of the ink jet printer head of FIG. 2.
Figure 4:
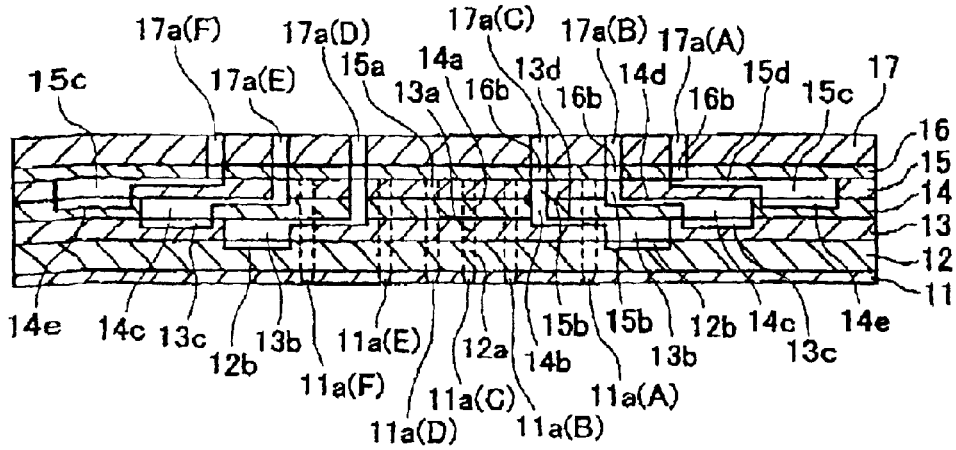
FIG. 4 is a cross-sectional view taken along line IV—IV of FIG. 2.

Next, the configuration of the cavity plate 10 will be described while referring to FIGS. 3 and 4. As shown in FIGS. 3 and 4, the cavity plate 10 has a seven-layer configuration made from seven thin layers of rectangular metal plates. The seven layers are, from the bottom up, a nozzle plate 11, a first manifold plate 12, a second manifold plate 13, a third manifold plate 14, a fourth manifold plate 15, a spacer plate 16, and a base plate 17. It should be noted that the cavity plate 10 is formed longer in the direction of the irregular break lines of FIG. 3.

The nozzle plate 11 is formed through with six columns A to F of small-diameter nozzles 11*a* for ejecting ink. The first manifold plate 12 is formed with six columns of through holes 12*a* and two ink channels 12*b*. The through holes 12*a* are formed through the first manifold plate 12 and serve as small diameter ink channels connected with the nozzles 11*a*. The ink channels 12*b* are each formed from a channel-shaped indentation and serve to supply ink to ink supply ports 17*a* of the base plate 17 (to be described later). The ink channels 12*b* extend following the columns of through holes 12*a* on either side of the columns of through hole 12*a*. As shown in FIG. 4, the ink channels 12*b* are formed to a depth that is about ⅓ the thickness of the first manifold plate 12.

The second manifold plate 13 is formed through with a plurality of columns of through holes 13*a*, two ink channels 13*b* to the outside of the through holes 13*a*, two ink channels 13*c* to the outside of the ink channels 13*b*, and shunt channels 13*d* extending inward from the ink channels 13*b*. The through holes 13*a* serve as small-diameter channels connected to the through holes 12*a*. The two ink channels 13*b* are channel-shaped through holes that are located on either side of the columns of through holes 13*a* at positions that correspond to positions of the ink channels 12*b*, so as to extend following the columns of through holes 12*a*. Several shunt channels 13*d* extend from each of the ink channels 13*b* and are for supplying ink to the ink supply ports 17*a* (to be described later). The two ink channels 13*c* are channel-shaped indentations formed, as shown in FIG. 4, to a depth of about ½ the thickness of the second manifold plate 13. The ink channels 13*c* are disposed to the outside of the ink channels 13*b* and extend following the ink channels 13*b*.

The third manifold plate 14 is formed through with a plurality of columns of through holes 14*a*, 14*b*, two ink channels 14*c* to the outside of the through holes 14*a*, 14*b*, two ink channels 14*e* to the outside of the ink channels 14*c*, and shunt channels 14*d* extending inward from the ink channels 14*c*. The through holes 14*a* serve as small-diameter channels connected to the through holes 13*a*. The two ink channels 14*c* are channel-shaped through holes, that are located on either side of the columns of through holes 14*a* at positions that correspond to positions of the ink channels 13*c*, so as to extend following the columns of through holes 14*a*. Several shunt channels 14*d* extend from each of the ink channels 14*c* and are for supplying ink to the ink supply ports 17*a* (to be described later). The two ink channels 14*e* are channel-shaped indentations. The ink channels 14*e* are disposed to the outside of the ink channels 14*c* and extend following the ink channels 14*c*. As shown in FIG. 4, the ink channels 14*e* are formed to a depth of about ½ the thickness of the third manifold plate 14. The through holes 14*b* serve as small-diameter channels for supplying ink from the ink supply shunts 13*d* to the ink supply ports 17*a*.

The fourth manifold plate 15 is formed through with a plurality of columns of through holes 15*a*, 15*b*, two ink channels 15*c* to the outside of the through holes 15*a*, 15*b*, and shut channels 15*d* extending inward from the ink channels 15*c*. The through holes 15*a* serve as small-diameter channels connected to the through holes 14*a*. The two ink channels 15*c* are channel-shaped through holes that are located on either side of the columns of through holes 15*a* at positions that correspond to positions of the ink channels 14*e*, so as to extend following the columns of through holes 15*c*. Several shunt channels 15*d* extend from each of the ink channels 15*c* and are for supplying ink to the ink supply ports 17*a* (to be described later). The through holes 15*b* serve as small-diameter channels for supplying ink from the ink supply shunts 14*d* to the ink supply ports 17*a*.

Sets of corresponding ink channels 12*b* and 13*b*, 13*a* and 14*c*, and 14*e* and 15*c*, form manifolds that are connected at one lengthwise end to a separate ink tank (not shown). As beat viewed in FIG. 4, the manifolds formed by ink channel sets 12*b* and 13*b*, 13*c* and 14*c*, and 14*e* and 15*c*, are all formed at a different levels. With this configuration, the manifold channels that supply ink to the supply ports of the pressure chambers are independent for each column of pressure chambers. In particular, the manifold channels for columns C and D are at different heights from the manifold go channels for columns B and E in the direction perpendicular to a plane defined by the pressure chambers. Therefore, there will be no interference when the ink color is different for each column.

The spacer plate 16 is formed with two sets of through holes 16*a* and 16*b*. The through holes 16*a* serve as small-diameter channels connected to the through holes 15*a*. The through holes 16*b* are for supplying ink to the ink supply ports 17*a* (to be described later).

The base plate 17 is formed with six columns A to F of parallelogram-shaped ink pressure chambers 17*c* in a one-to-one correspondence with the nozzles 11*a*. Each ink pressure chamber 17*c* is provided with one of the ink supply ports 17*a* in one of the acute-angle portions thereof and with an ink nozzle ports 17*b* in the other acute-angle portion thereof. The ink supply ports 17*a* are for supplying ink to the ink pressure chambers 17*c*. The ink nozzle ports 17*b* are for feeding ink to the ink nozzles 11*a*.

Here, an explanation will be provided for the reason for configuring the pressure chambers 17*c* so that ink is ejected by propagation of pressure across the lengthwise dimension of the diagonal lines of the parallelogram shape. When the volume of the pressure chamber is increased before ink is ejected, a pressure wave fluctuation is generated in the ink in the pressure chamber. The volume of the pressure chamber is then decreased while the pressure in the pressure chamber is high. The pressure applied to the ink at this time is superimposed on the initial high pressure so that ink can be efficiently ejected.

With this configuration, the frequency that ink can be ejected during any period depends on the cycle of the pressure wave fluctuation in the ink. Therefore, if the two ports 17*a*, 17*b* are separated by a short distance, then the ink can be ejected in a short cycle. However, the piezoelectric elements function in the manner of electrical capacitors. Consequently, a certain amount of time is required after voltage is first applied to the piezoelectric element until a predetermined voltage is developed in the piezoelectric element. This portion of the voltage waveform is referred to as the "rising edge" of the voltage waveform. If the two ports 17*a*, 17*b* are separated by an excessively short distance, then the rise in pressure fluctuation will be faster than the rising edge of the voltage waveform. Therefore, the pressure chamber needs to be a certain length so that the pressure wave propagation will take a certain amount of time. This is made possible in the present embodiment by configuring the pressure chambers 17*c* so that ink is ejected by propagation of pressure across the lengthwise dimension of the diagonal lines of the parallelogram shape. This configuration also provides the pressure chambers with a length and width sufficient for the piezoelectric elements to deform by an amount required for proper ink ejection. Also, both lengthwise ends of the pressure chambers 17*c* are formed in a narrow tapered shape in order to provide a plurality of pressure chambers in a sufficiently high density. With this configuration, bubbles. can be easily ejected out of the nozzles during ink ejection or ink suction (purging) operation even if air is accidentally introduced into the pressure chamber 17*c* along with the ink. Thus, detrimental phenomena such as prevention of ink ejection by the bubble is avoidable.

Figure 5A:
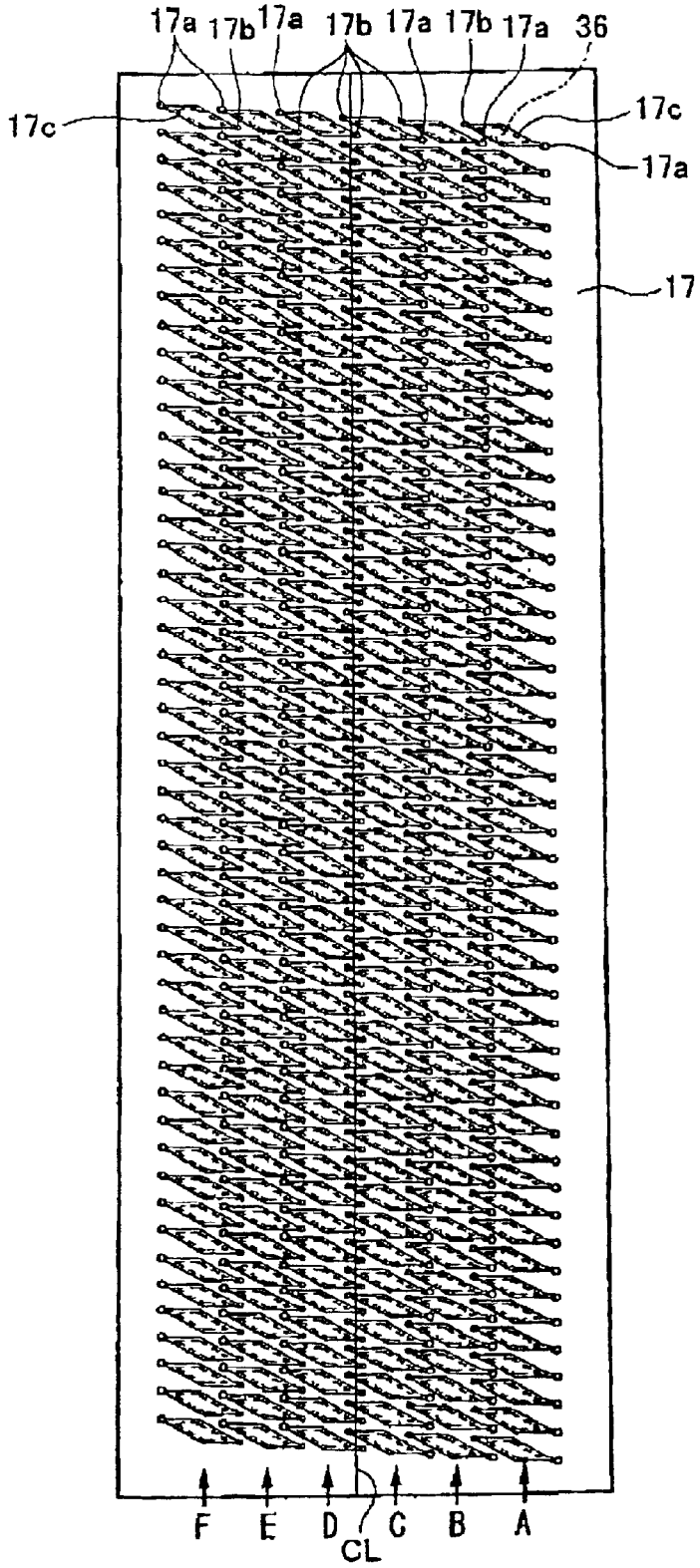
FIG. 5 is a plan view showing configuration of a base plate of the cavity plate.
Figure 5B:
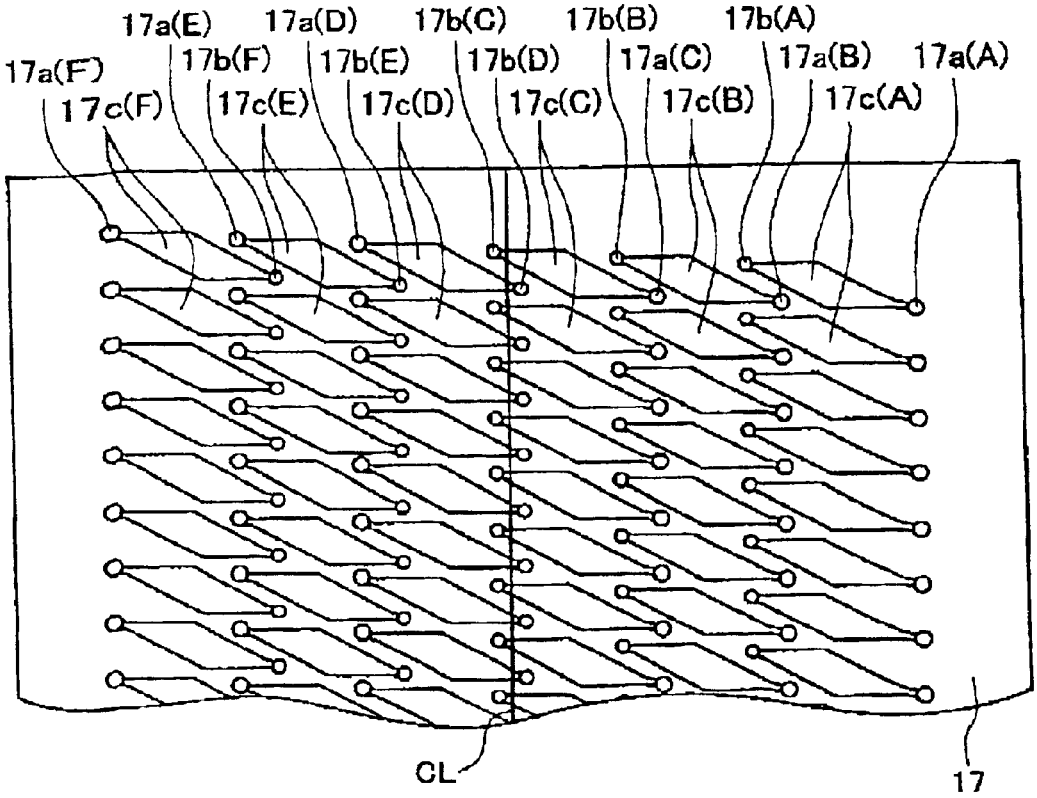

Next, the configuration of the base plate 17 will be described in more detail while referring to FIGS. 5(*a*) and 5(*b*). As shown in FIG. 5(*a*), the base plate 17 is formed in a substantially rectangular shape from a thin metal plate. The ink pressure chambers 17*c* are aligned in six columns A to F that extend substantially in parallel in the lengthwise direction of the rectangular-shaped base plate 17.

Arrangement of the ink pressure chambers 17*c* will be described with respect to an imaginary central line CL, which connects the centers of the short sides of the rectangular base plate 17. The ink pressure chambers 17*c* in the column A are arranged furthest to the right from the central line CL as viewed in FIGS. 5(*a*) and 5(*b*) and so are the outermost ink pressure chambers 17*c* of pressure chambers in rightward columns A, B, and C. The ink pressure chambers 17*c* of column B are arranged nearer the imaginary central line CL than the ink pressure chambers 17*c* of column A, that is, to the left of column A as viewed in FIGS. 5(*a*) and 5(*b*). The ink pressure chambers 17*c* of column C are arranged nearer the imaginary central line CL than the ink pressure chambers 17*c* of column B, that is, to the left of column B as viewed in FIGS. 5(*a*) and 5(*b*).

The ink pressure chambers 17*c* in the column F are arranged furthest to the left as viewed in FIGS. 5(*a*) and 5(*b*), and so are the outermost pressure chambers of pressure chambers in the leftward columns D, E, and F. The ink pressure chambers 17*c* of column E are arranged nearer the imaginary central line CL than the ink pressure chambers 17*c* of column F, that is, to the right of column F as viewed in FIGS. 5(*a*) and 5(*b*). The ink pressure chambers 17*c* of column D are arranged nearer the imaginary central line CL than the ink pressure chambers 17*c* of column E, that is, to the right of column E as viewed in FIGS. 5(*a*) and 5(*b*).

Ink pressure chambers 17*c* completely or mostly disposed on one side of the central line CL are oriented so that the ink nozzle ports 17*b* formed in one of the acute-angle portions face in the same direction That is, the ink pressure chambers 27*c* in the columns A, B, and C are oriented so that the ink nozzle ports 17*b* formed in one of the acute-angle portions of each ink pressure chamber 17*c* face leftward as viewed in FIGS. 5(*a*) and 5(*b*). The ink pressure chambers 17*a* in the columns D, E, and F are oriented 30 that the ink nozzle ports 17*b* formed in one of the acute-angle portions of each ink pressure chamber 17*c* face rightward as viewed in FIGS. 5(*a*) and 5(*b*).

As best seen in FIG. 5(*b*), the ink nozzle ports 17*b* of the ink pressure chambers 17*c* in column A are interposed between ink supply ports 17*a* of adjacent ink pressure chambers 17*c* in column B, Also, the ink nozzle ports 17*b* in ink pressure chambers 17*c* of column B are interposed between the ink supply ports 17*a* of adjacent pressure chambers 17*c* in column C. Similarly, the ink nozzle ports 17*b* of the ink pressure chambers 17*c* in column F are interposed between ink supply ports 17*a* of adjacent ink pressure chambers 17*c* in column E. Also, the ink nozzle ports 17*b* in ink pressure chambers 17*c* of column E are interposed between the ink supply ports 17*a* of adjacent pressure chambers 17*c* in column E. The ink nozzle ports 17*b* of the ink pressure chambers of column C are interposed between the ink nozzle ports 17*b* of adjacent ink pressure chambers 17*c* of column D.

With this configuration, the ejection-nozzle-side acute-angle portions of pressure chambers 17*c* in the columns C and D are interposed between pressure chambers of the other of the columns C and D. Further, the ejection-nozzle-side acute-angle portions of pressure chambers 17*c* in the column B are interposed between the ink-supply-side acute-angle portion of pressure chambers 17*c* in the column C and the ejection-nozzle-side acute-angle portions of pressure chambers 17*c* in the column E are interposed between the ink-supply-side acute-angle portion of pressure chambers 17*c* in the column D. This configuration enables positioning nozzles closer together nearer to the center of the ink jet printer head.

Next, the configuration of the plate-shaped piezoelectric actuator 20 will be described while referring to FIGS. 6 to 9. The plate-shaped piezoelectric actuator 20 is formed from 10 piezoelectric sheets 21 to 30, stacked together into a laminated body. As shown in FIG. 7, the piezoelectric sheets 26, 28, and 30 of the piezoelectric sheets 21 to 30 all have the same configuration. Drive electrodes 36 are formed on the upper surface of each of the piezoelectric sheets 26, 28, and 30 at positions that correspond to the ink pressure chambers 17*c*. The drive electrodes 36 are shaped similar to, but slightly smaller than, the projected shape of the parallelogram-shaped ink pressure chambers 17*c*, so that a large and efficient pressure fluctuation can be achieved in the pressure chambers 17*c*.

Figure 7:
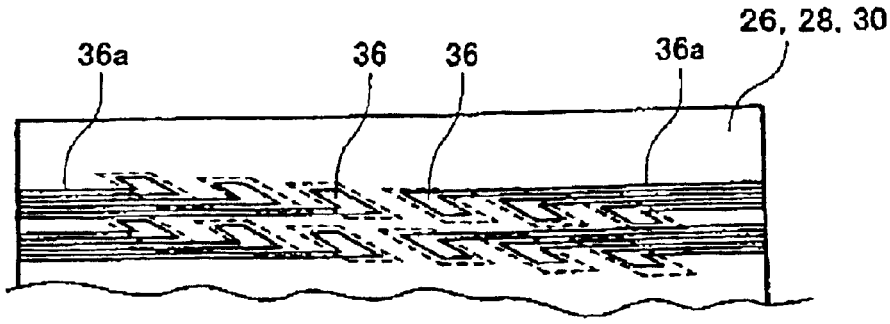
FIG. 7 is a plan view showing piezoelectric sheets that configure the plate-shaped piezoelectric actuator.
Figure 8:
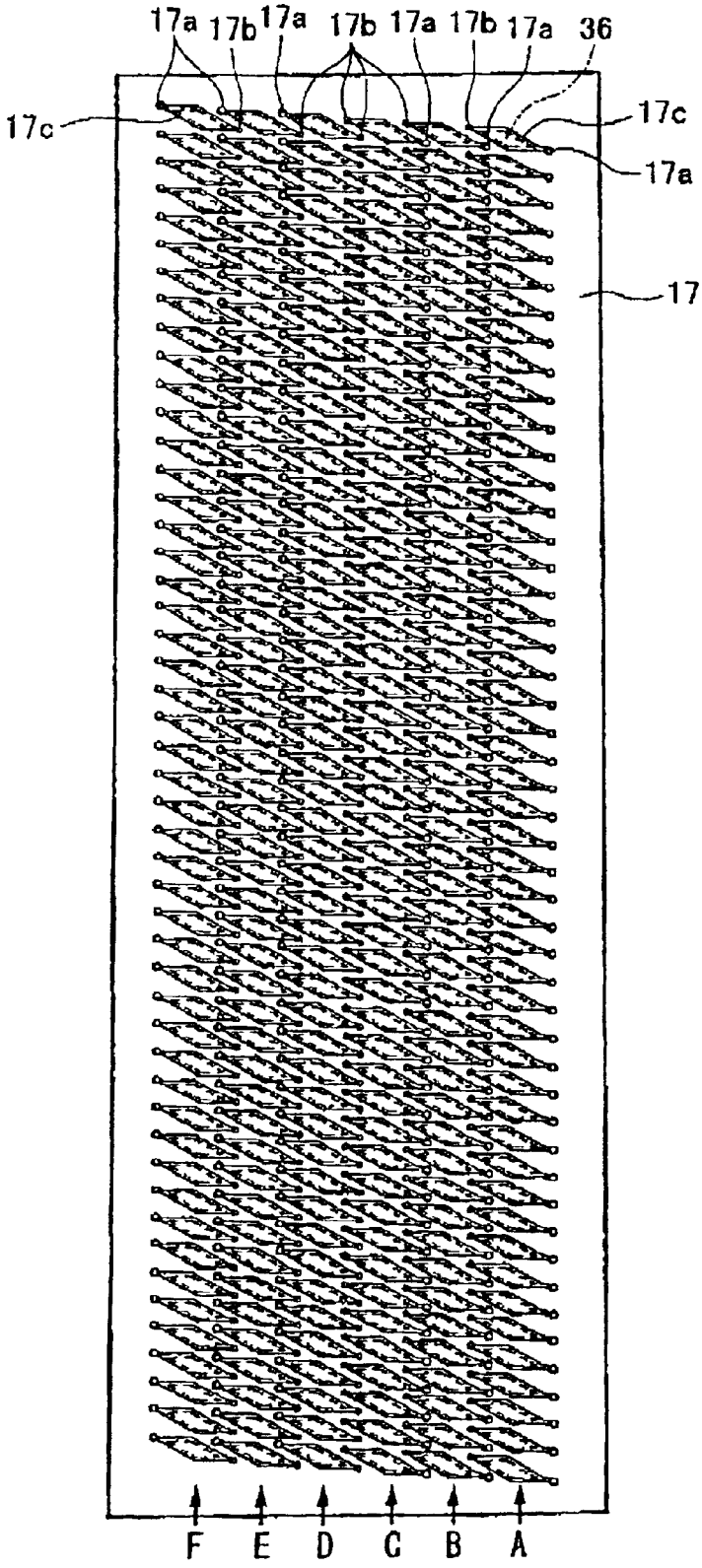
FIG. 8 is a plan view showing positions of individual electrodes with respect to pressure chambers of the base plate of FIG. 5.
Figure 9:
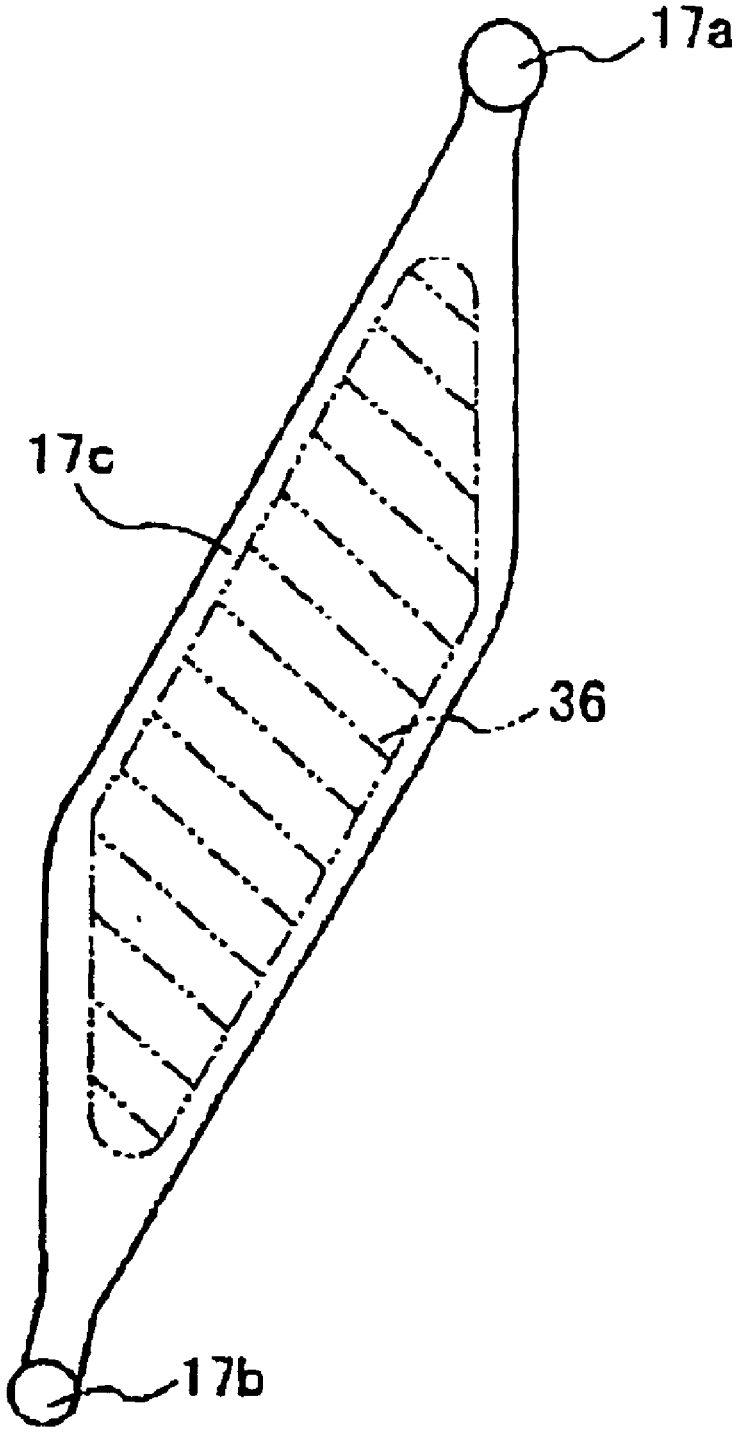
FIG. 9 is a magnified view showing positional relationship of an individual electrode and the corresponding ink pressure chamber of the base plate.

It should be noted that the drive electrodes 36 are arranged on the piezoelectric sheets 26, 28, and 30 to align with the ink pressure chambers 17*c* as shown in FIGS. 8 and 9 when the plate-shaped piezoelectric actuator 20 is placed on the surface of the base plate 17, which is part of the cavity plate 10, As shown in FIG. 7, wiring 36*a* for the drive electrodes 36 is formed on the piezoelectric sheets 26, 28, and 30 so as to be exposed to the side edge surfaces (i.e., the left and right sides as shown in FIG. 7) of the piezoelectric sheets 26, 28, and 30.

Figure 6:
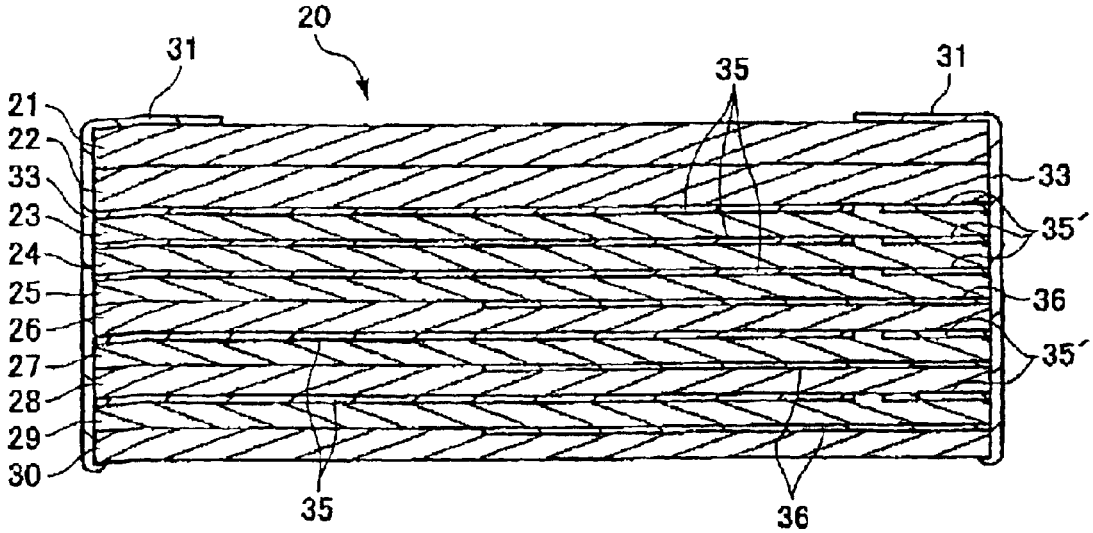
FIG. 6 is a cross-sectional view taken along line VI—VI of FIG. 2 showing a plate-shaped piezoelectric actuator of the ink jet printer head.

As shown in FIG. 6, all of the piezoelectric sheets 23, 24, 25, 27, and 29 are formed with the same configuration. Band-shaped common electrodes 35 are formed on the upper surface of each of the piezoelectric sheets 23, 24, 25, 27, and 29. The common electrodes 35 serve as electrodes shared by a plurality of the ink pressure chambers 17*c*. The common electrodes 35 are formed on the piezoelectric sheets 23, 24, 25, 27, and 29 so that an edge portion 35*a* of each common electrode 35 is exposed from the side edge surface of the piezoelectric sheets 23, 24, 25, 27, and 29. Dummy pattern electrodes 35' are formed on the upper surface of each of the piezoelectric sheets 23, 24, 25, 27, and 29. The dummy patterns 35' are formed at positions that correspond to positions of the edge portions of the wiring 36*a* of the drive electrodes 36, but do not contribute to deformation of the piezoelectric sheets 23, 24, 25, 27, and 29. The dummy pattern electrodes 35' are formed with the same thickness as the drive electrodes 36 and the common electrodes 35 in order to reinforce the piezoelectric sheets from bending at positions where no drive electrode 36 or common electrodes 35 are formed when the piezoelectric sheets are laminated together as will be described later.

It should be noted that although the embodiment describes the plate-shaped piezoelectric actuator 20 as having three layers of piezoelectric sheets 26, 28, and 30 formed with the drive electrodes 36, one layer, two layers, five layers, or any optional number of layers of piezoelectric sheets formed with the drive electrodes 36 could be provided. Also, piezoelectric sheets formed with a common electrode 35 could be provided in the same optional number as the sheets with drive electrodes 36.

The piezoelectric sheets 25 to 29 can be locally deformed by applying a drive voltage between the common electrode 35 of the piezoelectric sheet 25 and a selected drive electrode 36 of the piezoelectric sheet 26, between the common electrode 35 of the piezoelectric sheet 27 and a selected drive electrode 36 of the piezoelectric sheet 28, to and between the common electrode 35 of the piezoelectric sheet 29 and a selected drive electrode 36 of the piezoelectric sheet 30. The deformation applies pressure to the ink filling the corresponding ink pressure chamber 17*c* of the cavity plate 10. Accordingly, the portion of the piezoelectric sheets 25 to 29 that corresponds to the drive electrodes 36 serves as the active portion of the piezoelectric sheets 21 to 30.

When the piezoelectric sheets 21 to 30 are subjected to sintering processes, the metallic portions which configure the electrodes, and the piezoelectric ceramics of the piezoelectric sheets 21 to 30 contract by different amounts. The piezoelectric sheets 21 to 24 serve to prevent "flatness" of the piezoelectric sheets 21 to 30 from being compromised by the sintered sheets 21 to 30 turning up at the edges or warping. The piezoelectric sheets 21 to 24 also serve as a binding layer that insures that the active portions of the piezoelectric sheets 25 to 29 deform only toward the ink pressure chambers 17*c*.

The operation of the ink jet printer head 1 will be described while referring to FIGS. 3, 4, 5(*b*), 8, and 9. The following explanation will be provided for only the right three columns A, B, and C of the ink jet printer head 1. However, the ink jet printer head 1 has a substantially symmetrical shape on right and left sides as indicated by the same numbering, so operation of the left three columns D, E, and F is substantially the same as for the right three columns A, B, and C.

First, operation for supplying ink to pressure chambers 17*c* and nozzles 11*a* of column A will be described. As shown in FIG. 4, ink from the ink manifold channels configured from the ink channels 14*e* and 15*c* is supplied through the shunt channels 15*d* to the through holes 16*b* of column A. The ink flows through the corresponding column-A through holes 17*b* and ink supply ports 17*a* and into ink pressure chambers 17*c* of column A shown in FIG. 5(*b*). When a drive voltage is applied to one of the drive electrodes 36 shown in FIGS. 8 and 9, the corresponding portion of the plate-shaped piezoelectric actuator 20 deforms, thereby ejecting ink that fills the corresponding column-A ink pressure chamber 17*c* out through the nozzle port 17*b* and out through the corresponding column-A nozzle 11*a* via the through holes 16*a*, 15*a*, 14*a*, 13*a*, and 12*a* shown in FIG. 3.

Next, operation for supplying ink to pressure chambers 17*c* and nozzles 11*a* of column B will be described. As shown in FIG. 4. ink from the ink manifold channels configured from the ink channels 13*c* and 14*c* is supplied through the shunt channels 14*d* and through holes 15*b* to the through holes 16*b* of column B. The ink then flows through the corresponding column-B ink supply ports 17*a* into the ink pressure chambers 17*c* of column B shown in FIG. 5(*b*). When a drive voltage is applied to one of the drive electrodes 36 Shown in FIGS. 8 and 9 for pressure chambers 17*c* of column B, the corresponding portion of the plate-shaped piezoelectric actuator 20 deforms, thereby ejecting ink that fills the corresponding column-B ink pressure chamber 17*c* out through the nozzle port 17*b* and out through the corresponding column-B nozzle 11*a* via the through holes 16*a*, 15*a*, 14*a*, 13*a*, and 12*a* shown in FIG. 3.

Next, operation for supplying ink to pressure chambers 17*c* and nozzles 11*a* of column C will be described. As shown in FIG. 4, ink from the ink manifold channels configured from the ink channels 12*b* and 13*b* is supplied through the shunt channels 13*d* and through holes 14*b*, 15*b* to the through holes 16*b* and ink supply ports 17*a* of column C. The ink then flows into the ink pressure chambers 17*c* of column C shown in FIG. 5(*b*). When a drive voltage is applied to one of the drive electrodes 36 shown in FIGS. 8 and 9 for pressure chambers 17*c* of column C, the corresponding pressure generating portion of the plate-shaped piezoelectric actuator 20 deforms, thereby ejecting ink that fills the corresponding column-C ink pressure chamber 17*c* out through the nozzle port 17*b* and out through the corresponding column-A nozzle 11*a* via the through holes 16*a*, 15*a*, 14*a*, 13*a*, and 12*a* shown in FIG. 3.

Because the pressure chambers 17*c* are formed in a substantial parallelogram shape and the ink supply port 17*a* and ink nozzle port 17*b* are at opposite diagonal corners of the parallelogram shape, a proper distance can be secured in the pressure chambers 27*c* between the ink supply port 17*a* and the ink nozzle port 17*b*. This enables driving the pressure generating portions of the plate-shaped piezoelectric actuator 20 with a slower rising edge time and deforming the pressure generating portions by a sufficient amount.

Because the cavity plate is formed with six or more columns of ink nozzles, a cavity plate with the same size as a conventional cavity plate can be provided with more ink pressure chambers 17*c*. Because the ink nozzle ports 17*b* provided to the parallelogram-shaped ink pressure chamber 17*c* are disposed closer than the supply ports 17*a* are to the imaginary central line CL, which connects the center of the shorts sides of the rectangular cavity plate 10, the ink nozzle columns can be concentrated in the center of the ink jet printer head 1 Accordingly, capping and wiping operations are easier to perform.

Also, even if the ink jet printer head 1 is attached with some slant with respect to the direction of relative movement between the ink jet printer head 1 and the recording medium, shift in positions where ink droplets ejected from nozzles columns impinge on the recording medium can be reduced so that printing quality can be increased.

Because the ink pressure chambers 17*c* are parallelogram shaped with acute and obtuse angled portions, the length and width of the corresponding active portion of the plate-shaped piezoelectric actuator 20 can be larger so that the ratio of effective active surface area of the piezoelectric sheet can be increased and efficiency of the plate-shaped piezoelectric actuator 20 can be increased.

It should be noted that the pressure chambers of the first embodiment are arranged so that, although the pressure chambers are partially interposed between each other, the or portion, or the principal portion, of each pressure chamber in one column is shifted out of alignment from principal portions of pressure chambers in adjacent columns with respect to the direction in which the long side of the pressure chambers extend. This configuration prevents cross talk.

Figure 10:
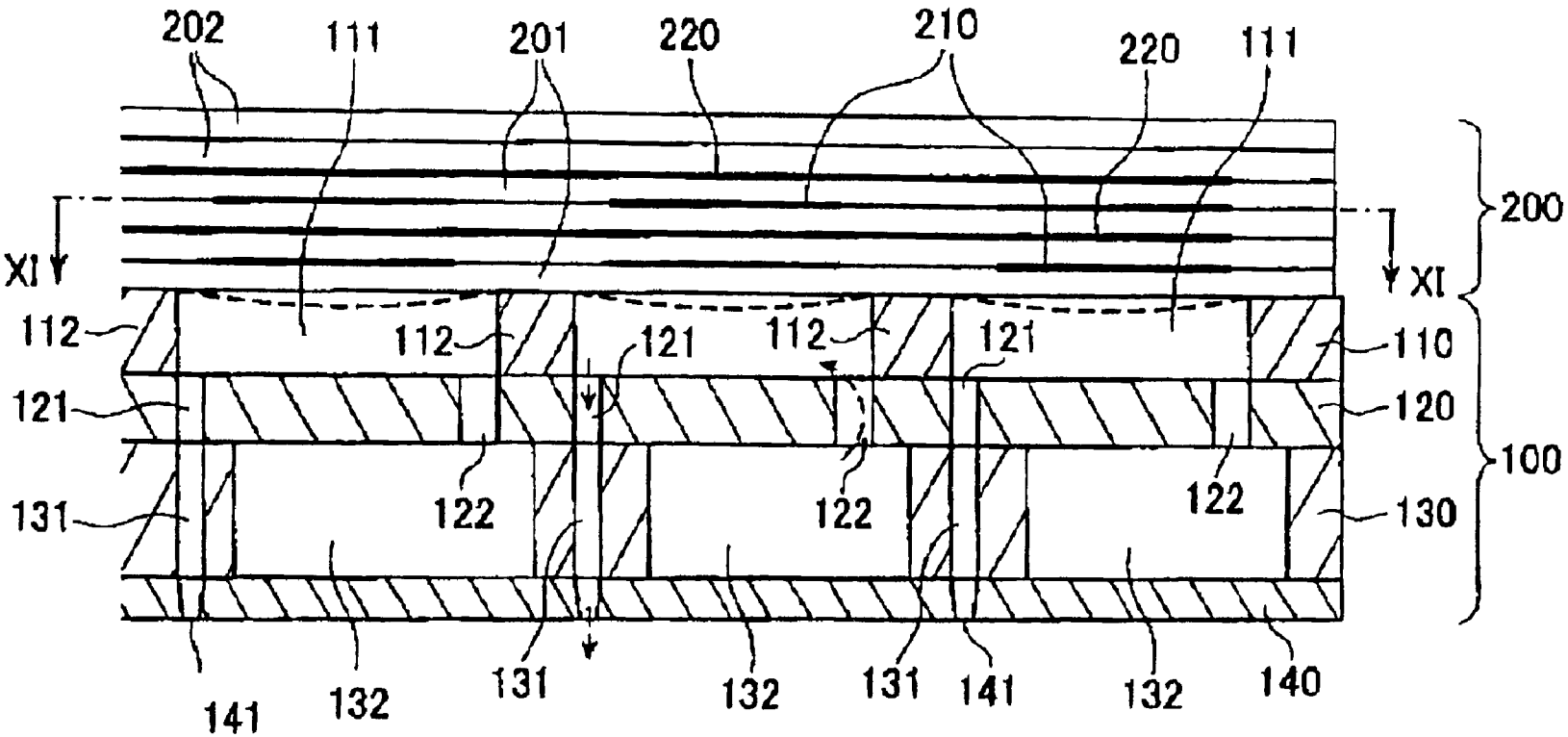
FIG. 10 is a cross-sectional view showing an ink jet printer head according to a second embodiment of the present invention, wherein the view is taken along line X—X of FIG. 11 showing.

This feature of the present invention will be described in more detail using a second embodiment shown in FIGS. 10 to 12. As shown in FIG. 10, the ink jet printer head according to the second embodiment includes a cavity unit 100 and an actuator unit 200. The cavity unit 100 includes a plurality of plates 110, 120, 130, and 140 adhered to each other in a laminated configuration. The uppermost layer plate 110 includes a plurality of pressure chambers 111 aligned in a two-dimensional matrix extending in the left and right directions and in the depth direction of FIG. 10. The depth direction extends perpendicular to the surface of the sheet drawn with FIG. 10. Each of the pressure chambers 111 has a parallelogram shape to be described later. The lowermost layer plate 140 includes a plurality of ejection nozzles 141. One side of each pressure chamber 111 is connected to a nozzle 141 via through holes 121, 131 opened through the plates 120, 130. The other side of each pressure chamber 111 is connected to a manifold channel 132 of the plate 130 via a through hole 122 opened through the plate 120. Each of the manifold channels 132 extend in the depth direction of FIG. 10 and is connected via the through holes 122 to the plurality of pressure chambers 111 aligned in the same row in the depth direction of FIG. 10. One end of each manifold channel 132 is connected to an ink tank (not shown), for example, and serves is an ink supply source. Each manifold channel 132 is independent for each row of pressure chambers 111 and supplies different color ink from the corresponding ink tank to the separate rows of pressure chambers 111. It should be noted that one manifold channel 132 could be connected to a plurality of rows of pressure chambers 111 and supply the same color ink to all of the rows.

The actuator unit 200 is a laminated configuration adhered onto the cavity unit 100 and includes two pluralities of piezoelectric ceramic sheets 201, 202. Individual electrodes 210 and common electrodes 220 are interposed in alternation between the ceramic sheets 201. The individual electrodes 210 are disposed at positions corresponding to the pressure chambers 111. The common electrodes 220 each cover the entire region of the plurality of individual electrodes 210. The ceramic sheets 201 are subjected to polarization processes so that the portion of ceramic sheets 201 sandwiched between the individual electrodes 210 and the common electrodes 220, that is, the portion with the projected shape of the individual electrodes 210, serves as a pressure generating portion. The pressure generating portion extends or contracts with respect to the corresponding pressure chamber 111 when a voltage is applied between the individual electrodes 210 and the common electrodes 220 that are stacked in the laminated direction.

It is desirable that a voltage be applied to extend the pressure generating portions into the pressure chambers 111 as indicated by the broken line in FIG. 10 except when ink ejection is to be performed When ink is to be ejected from one of the nozzles 141, then application of voltage is stopped at the corresponding voltage generating portion so that the voltage generating portion retracts to its flat condition As a result, the volume of the pressure chamber 111 increases so that ink from the manifold channel 132 enters into the corresponding pressure chamber 111. Ink can be ejected from the pressure chamber by again applying voltage so that the voltage generating portion deforms to apply pressure to the ink in the pressure chamber 111.

Alternatively the pressure generating portions can be maintained in a flat condition until ink is to be ejected. When ink is to be ejected, a voltage is applied to contract the corresponding pressure generating portion, then the voltage is stopped to return the pressure generating portion to a flat condition to eject ink. In another alternative, a pressure generating portion can be applied with voltage while in a flat condition to extend the pressure generating portion into the ink pressure chamber to apply pressure to the ink.

The ceramic sheets 202 are not sandwiched by electrodes and so do not function as pressure generating portions. Instead the ceramic sheets 202 are disposed at the opposite side of the ceramic sheets 201 from the pressure chambers 111 and so suppress deformation of the pressure generating portions of the ceramic sheets 201 upward. Said differently, the ceramic sheets 202 direct deformation of the ceramic sheets 201 toward the pressure chambers 111.

Figure 11:
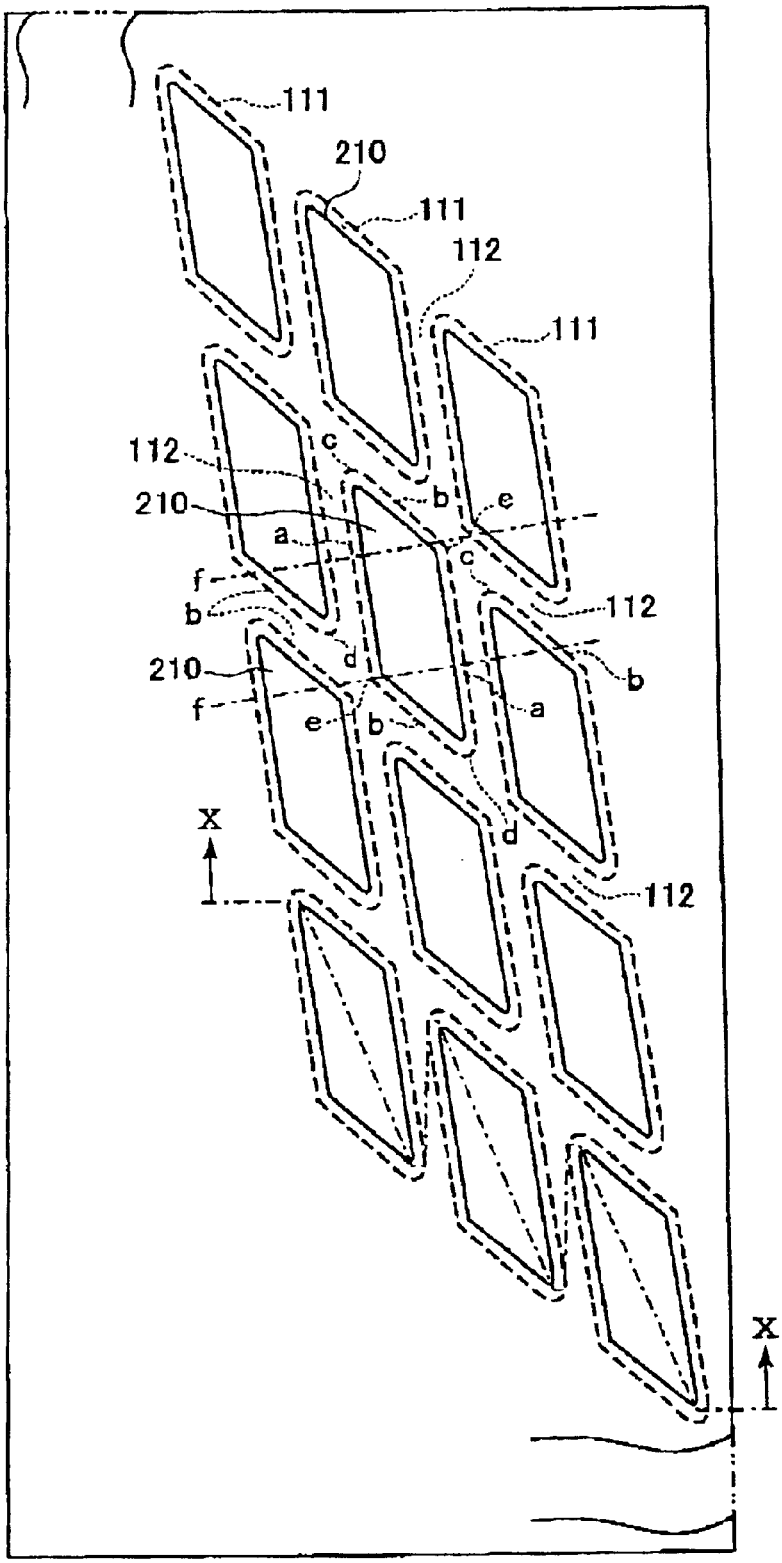
FIG. 11 is a plan view showing individual electrodes of an actuator and positional relationship to pressure chambers of the ink jet printer head of FIG. 10.
Figure 12:
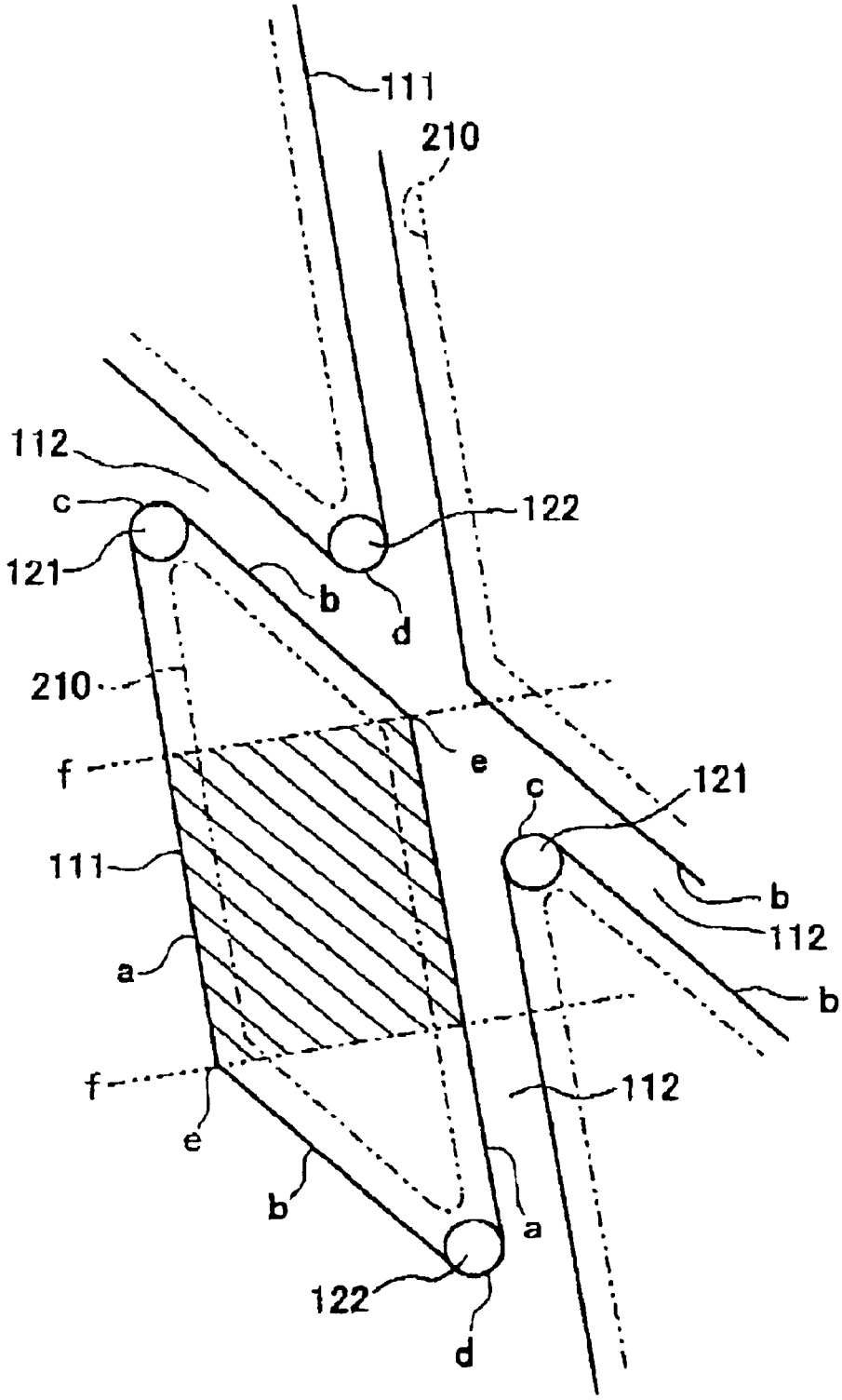
FIG. 12 is a magnified plan view showing configuration and orientation of pressure chambers.

As shown in FIGS. 11 and 12, the pressure chambers 11 each have a substantial parallelogram shape (located within an imaginary plane) that defines a parallel pair of long lines a and a parallel pair of short lines b, wherein the short lines b are slanted with respect to the long lines a. The pressure chambers 111 are arranged in a plurality of columns, which are aligned substantially with the long lines a, and rows, which are aligned in substantially with the short lines b. According to the present embodiment, the pressure chambers 111 in the same column are connected by the same common manifold channel 132. Adjacent pressure chambers 11 are separated by partition walls 112.

The side walls aligned with long and short lines a and b intersect, that is, connect at two acute-angle portions c, d and two obtuse-angle portions e, e. A through hole 121 in fluid connection with a corresponding ejection nozzle 141 is formed at the acute-angle portion c and a through hole 122 in fluid connection with the manifold channel 132 is formed in the other acute-angle portion d. With this configuration, ink is ejected by propagation of pressure across the lengthwise dimension following an imaginary diagonal line that extends between the two acute-angle potions c, d in the same manners as in the first embodiment, so the same good effects are achieved.

Similarly to the first embodiment, the individual electrodes 210 are shaped the same as, but smaller than, the projected form of the pressure chambers 111. Accordingly, the pressure generating portions of the actuator have the same shape. The individual electrodes 210 need not be the same shape as the pressure chambers 111, but it is desirable that the individual electrodes 210 be shapes the same as, but smaller than, the projected form of the pressure chambers 111 in order to generate a large and efficient pressure fluctuation in the pressure chambers 111.

Although not shown in the drawings, lead lines for supplying power to the individual electrodes 210 are formed on the ceramic sheets 202 along with the individual electrodes 210 by screen printing, for example, so as to pass between the individual electrodes 210, that is, at positions that correspond to the partition walls 112, until reaching the edge of the actuator unit 200. Also, the lead wires pass through through holes that penetrate through the ceramic sheets 202 at positions between the individual electrodes and are formed onto the upper surface of the actuator unit 200.

According to the present invention, the "principal portion" of a pressure chamber 111 is the portion interposed between mutually confronting sections of the side walls that define the pair of long lines a, a. Said differently, the "principal portion" is the rectangular portion encompassed by the two long lines a, a and two perpendicular lines f, f as indicated by hashing in FIG. 12, wherein each perpendicular line f is drawn from one of the obtuse-angle portions e to the confronting long line a in a direction perpendicular with the confronting long line a. The pressure chambers 111 are arranged so that a principal portion in one column confronts, in a direction that extends perpendicular to one of the lines a, an acute-angle portion c or d and partition wall 112 of an adjacent column, wherein the partition wall 112 is sandwiched between short lines b, b, of two pressure chambers 111 in the adjacent column. With this configuration, principal portions of one column do not confront the principal portions of pressure chambers 111 in adjacent column.

Figure 1:
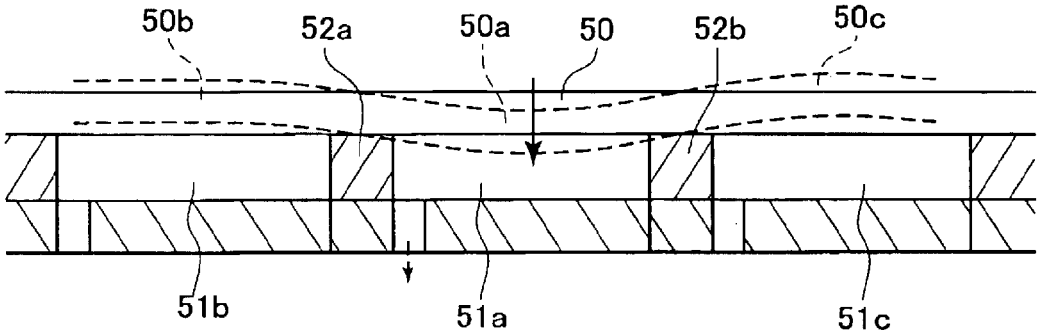
FIG. 1 is a cross-sectional view showing cross talk generated between adjacent ink pressure chambers of a conventional ink jet printer head.

The actuator unit deforms most into (or away from) the pressure chambers at the principal portions. If the principal portions of an adjacent pressure chamber were aligned in the direction perpendicular to one of the lines a, which is the direction of extension of the perpendicular lines f, f, then as explained with reference to FIG. 1 the deformation of the actuator into (or away from) one of the pressure chambers would also influence adjacent pressure chambers. However, with the configuration of the second embodiment, the portion of the actuator unit that is located at the principal portion of a pressure chamber in one column confronts, that is, in a direction that extends perpendicular to one of the lines a of the pressure chamber, portions of the actuator unit located 1) where the actuator unit is securely fixed to a partition wall 112 that is sandwiched between short lines b, b, of two pressure chambers 111 in an adjacent column and 2) where one of the acute-angle portions c or d are located for a pressure chamber 111 in the adjacent column. Therefore, even if the actuator is driven to deform greatly at the principal portion of the pressure chamber in the one column, the actuator unit will not deform at the partition wall 112 and will only slightly deform at the acute-angle portion c or d of the pressure chamber in the adjacent column. Therefore, the driven deformation will only slightly influence the adjacent pressure chamber. Accordingly, cross talk is reduced and predetermined ink ejection can be stably performed from each of the pressure chambers.

Figure 13:
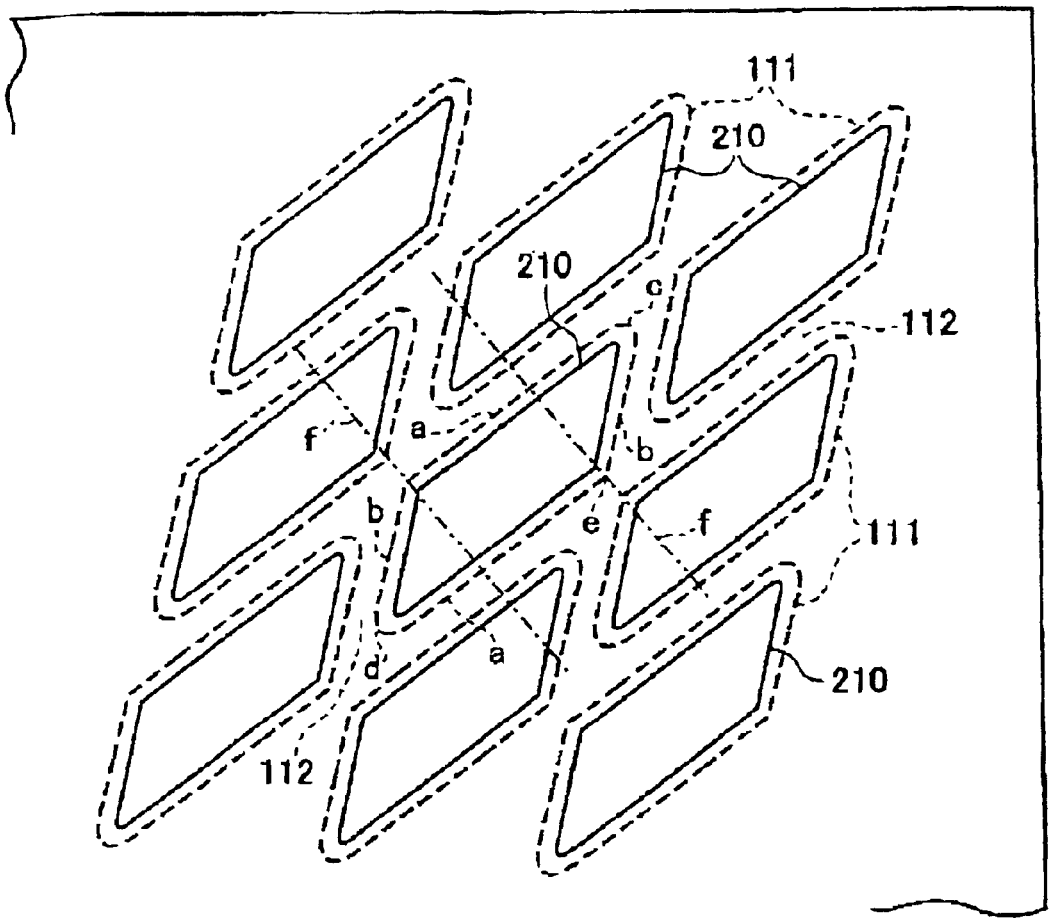
FIG. 13 is a plan view showing a first modification of the second embodiment.

Next, a first modification of the second embodiment will be described while referring to FIG. 13. The second embodiment described columns of pressure chambers extending to follow the direction in which the long lines a, a extend. However, according to the first modification of the second embodiment, the columns of pressure chambers extend following the direction in which the short lines b extend. With this configuration also, the principal portion of pressure chambers are not aligned in the direction of the perpendicular lines f, f, so cross talk can be reduced in the same manner as in the second embodiment.

Figure 14:
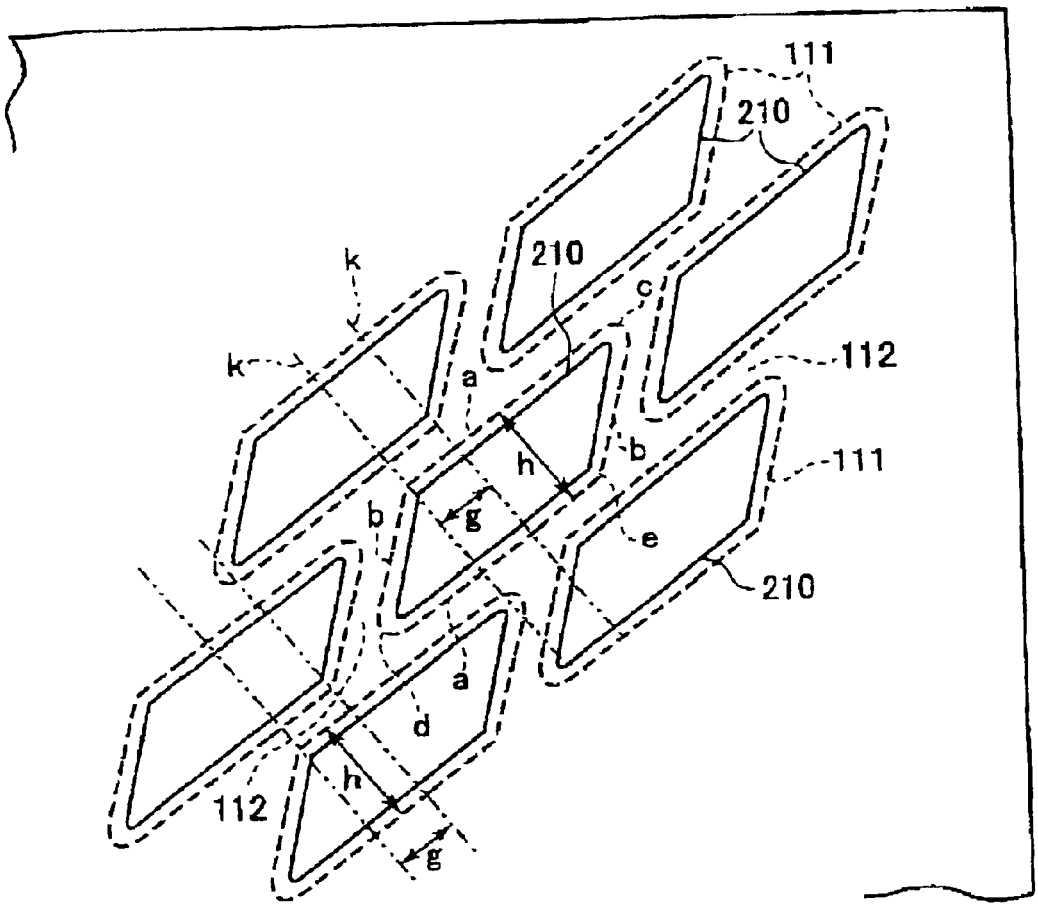
FIG. 14 is a plan view showing a second modification of the second embodiment.

Next, a second modification of the second embodiment of the invention will be described while referring to FIG. 14. In the second modification of the second embodiment, the principal portions of pressure chambers in adjacent rows are shifted out of alignment from each other as in the first and second embodiment and the first modification of the second embodiment, but partially confront each other by a width g that is smaller than the width h between the pair of first lines a, a of the pressure chambers. The width g is defined as the distance between lines k, k, wherein each line k extends through an obtuse-angled portion e of one of two pressure chambers in adjacent columns and is perpendicular to the long line a of the other pressure chamber. With this configuration, the substantial center of a principal portion confronts the partition wall 112 between short lines b, b of two adjacent pressure chambers in the adjacent column. As a result, deformation of the actuator unit into a pressure chamber in one column will only slightly influence the pressure chambers in adjacent pressure chambers, so that cross talk can be reduced.

The ink jet recording head of the second embodiment and its modifications has pressure chambers arranged so that lines defined by the walls of pressure chambers are mutually parallel and so that the principal portions defined between the long lines are shifted from each other in a direction parallel with the direction in which the lines extend. That is, the principal portions of two adjacent pressure chambers are shifted out of confrontation in a direction that is substantially perpendicular to the lengthwise direction of the partition wall that separates the adjacent pressure chambers. As a result, even if the actuator unit extends across a plurality of pressure chambers, when it deforms into one pressure chamber, it will only slightly influence adjacent pressure chambers through the partition wall. Cross talk can be suppressed and predetermined ink ejection can be stably performed from each pressure chamber.

One acute-angle portion of each parallelogram-shaped pressure chamber is provided with a through hole connected to an ejection nozzle. The other acute-angle portion is provided with a through hole connected to an ink supply source. With this configuration, ink can be ejected using the propagation of pressure waves in the direction following the lengthwise diagonal line of the parallelogram shape of the pressure chamber in the manner of the first embodiment. As a result, the pressure chamber can be sufficiently long to allow sufficient time for the rising edge of the voltage waveform applied to the actuator. Moreover, a predetermined amount of deformation can be achieved so that ink can be properly ejected.

While the invention has been described in detail with reference to specific embodiments thereof, it would be apparent to those skilled in the art that various changes and modifications may be made therein without departing from the spirit of the invention, the scope of which is defined by the attached claims.

For example, the first embodiment described provided six columns of ink pressure chamber 17*c*, but four, eight or other number of columns could be provided instead.

The actuator unit need not be formed by laminating a plurality of piezoelectric ceramic sheets as described in the embodiments. Instead, a vibration plate for a plurality of pressure chambers or a separate piezoelectric element or other pressure generating element for each pressure chamber can be attached to the upper wall of the pressure chambers.

Also, although the embodiment described the parallelogram shape of the pressure chambers as having long and short sides, the parallelogram shape could have all the same length. That is, the pressure chambers could be formed in a rhombic shape.

What is claimed is:

1. An ink jet printer head comprising:

a cavity plate formed with at least a first, second, and third column, each column including a plurality of pressure chambers aligned in a row, each pressure chamber having a substantial parallelogram shape with two opposing acute-angled corners, each pressure chamber having an ink-supply-side acute-angle portion located in one acute-angled corner and an ink-ejection-nozzle-side acute-angle portion located in the other acute-angled corner, the ink-supply-side acute-angle portion being formed with an ink supply opening and the ink-ejection-nozzle-side acute-angle portion being formed with an ink ejection nozzle opening, the ejection-nozzle-side acute-angle portions of pressure chambers in the first and second columns being interposed between ejection-nozzle-side acute-angle portions of pressure chambers of the other of the first and second columns, the ejection-nozzle-side acute-angle portions of pressure chambers in the third column being interposed between the ink-supply-side acute-angle portion of pressure chambers in one of the first and second columns; and an actuator in confrontation with the pressure chambers of the cavity plate, the actuator applying ejection pressure to the ink in the ink pressure chambers.

2. An ink jet printer head as claimed in claim 1, wherein the cavity plate has a substantial rectangular shape, the ink ejection nozzles of pressure chambers being aligned in at least four nozzle columns extending in a lengthwise direction of the substantially rectangular cavity plate.

3. An ink jet printer head as claimed in claim 1, wherein the cavity plate has a substantial rectangular shape, the parallelogram-shaped pressure chambers being aligned in six pressure chamber columns extending in a lengthwise direction of the substantially rectangular cavity plate.

4. An ink jet printer head as claimed in claim 1, wherein the cavity plate has a substantial rectangular shape with two short sides and two long sides, each pressure chamber being oriented so that the ink ejection nozzle opening is nearer than the ink supply opening to an imaginary central line extending between centers of the two short sides.

5. An ink jet printer head as claimed in claim 1, wherein the actuator is formed from a piezoelectric sheet sandwiched by pairs of electrodes, one electrode of each pair of electrodes having an equivalent parallelogram shape that is smaller sized than a projected shape of the corresponding parallelogram-shaped pressure chamber.

6. An ink jet printer head as claimed in claim 1, further comprising an independent manifold channel for each column of pressure chambers, each manifold channel supplying ink to the ink supply openings of the pressure chambers in the corresponding column, the manifold channel for the third column of pressure chambers being at a different height from the manifold channel for the one of the first and second columns of pressure chambers in a direction perpendicular to a plane defined by the one of the first and second columns of pressure chambers.

7. An ink jet printer head comprising:

a cavity plate formed with a plurality of pressure chambers, nozzles, and ink supply sources, the pressure chambers being arranged in at least three columns that extend parallel with each other in a column direction, each pressure chamber being connected to a corresponding nozzle through one end of the pressure chamber and to a corresponding ink supply source through the other end of the pressure chamber, each pressure chamber having a pair of first side walls extending parallel with the column direction, a principal portion of the pressure chamber being defined by the first side walls and two imaginary parallel lines that perpendicularly intersect the first side walls and each principal portion of one column of pressure chambers being arranged so that each principal portion is staggered from the principal portion of the pressure chamber of an adjacent column of pressure chambers; and an actuator in confrontation with the pressure chambers of the cavity plate, the actuator applying ejection pressure to the ink in the ink pressure chambers.

8. An ink jet printer head as claimed in claim 7, wherein each principal portion of one column of pressure chambers having an overlap section with the principal portion of the adjacent column of pressure chambers so that a length of the overlap section is less than a width between the first side walls.

9. An ink jet printer head as claimed in claim 8, wherein the substantially parallelogram shape of each pressure chamber includes two acute-angle portions, a through hole connected to the nozzle being formed in one acute-angle portion, a through hole connected to the ink supply source being formed in the other acute-angle portion.

10. An ink jet printer head as claimed in claim 7, wherein each pressure chamber having a substantially parallelogram shape defined by the pair of first side walls and a pair of second side walls intersecting with the first side walls, the pressure chambers being shifted from each other in the column direction so that the principal portions of pressure chambers in one column do not confront the principal portions of pressure chambers in an adjacent column in a direction perpendicular to the pair of first side walls.

11. An ink jet printer head as claimed in claim 10, wherein the substantially parallelogram shape of each pressure chamber includes two acute-angle portions, a through hole connected to the nozzle being formed in one acute-angle portion, a through hole connected to the ink supply source being formed in the other acute-angle portion.

12. An ink jet printer head as claimed in claim 7, wherein each pressure chamber having a substantially parallelogram shape defined by the pair of first side walls and a pair of second side walls intersecting with the first side walls, the pressure chambers being arranged so that a principal portion in one column confronts, in a direction perpendicular to the pair of first side walls thereof, an area between confronting second side walls of two adjacent pressure chambers in an adjacent column.

13. An ink jet printer head as claimed in claim 12, wherein the substantially parallelogram shape of each pressure chamber includes two acute-angle portions, a through hole connected to the nozzle being formed in one acute-angle portion, a through hole connected to the ink supply source being formed in the other acute-angle portion.

14. An ink jet printer head as claimed in claim 7, wherein each of the plurality of pressure generating portions of the actuator unit have substantially the same shape as the pressure chambers.

15. An ink jet printer head as claimed in claim 7, wherein the actuator unit includes a piezoelectric material and electrodes for applying voltage to the piezoelectric material, each of the pressure generating portions of the actuator unit being formed by at least the projected form of the corresponding electrode on the piezoelectric material.

16. An ink jet printer head as claimed in claim 7, wherein the pressure chamber is defined by the pair of first side walls and a pair of second parallel side walls, the first side walls are longer than the second side walls.

17. An ink jet printer head comprising:

a cavity plate formed with a plurality of pressure chambers, nozzles, and ink supply sources, the pressure chambers being arranged in a plurality of columns that extend parallel with each other in a column direction, each pressure chamber having a substantially parallelogram shape including two acute-angle portions, a through hole connected to the nozzle being formed in one acute-angle portion, a through hole connected to the ink supply source being formed in the other acute-angle portion, the pressure chambers being arranged so that the pressure chambers are shifted out of alignment with each other in a direction extending parallel with the column direction each pressure chamber having a pair of side walls that extend parallel with each other in the column direction; and an actuator unit disposed across the plurality of pressure chambers and including a plurality of pressure generating portions at positions that correspond to the pressure chambers.

18. An ink jet printer head comprising:

a cavity plate formed with a plurality of pressure chambers, nozzles, and ink supply sources, the pressure chambers being arranged in at least three columns that extend parallel with each other in a column direction, each pressure chamber having a substantially parallelogram shape, defined by a pair of first side walls that extend parallel with each other in the column direction and second side walls that extend parallel with each other, each pressure chamber being connected to a corresponding nozzle through one end of the pressure chamber and to a corresponding ink supply source through the other end of the pressure chamber, the pressure chambers being arranged so that the pressure chambers are shifted out of alignment with each other in the column direction; and an actuator unit disposed across the plurality of pressure chambers and including a plurality of pressure generating portions at positions that correspond to the pressure chambers.

19. An ink jet printer head as claimed in claim 18, wherein each pressure chamber includes two acute-angle portions, a first through hole connected to the nozzle being formed in one of the two acute-angle portions and a second through hole connected to the ink supply source being formed in the other of the two acute-angle portions.

20. An ink jet printer head as claimed in claim 18, wherein each pressure chamber confronts a portion sandwiched between the second side walls of pressure chambers in adjacent columns in a direction perpendicular to the column direction.

21. An ink jet printer head as claimed in claim 18, wherein the first side walls are longer than the second side walls.

22. An ink jet printer head as claimed in claim 18, wherein the first side walls are shorter than the second side walls.

23. An ink jet printer head as claimed in claim 18, wherein each of the plurality of pressure generating portions of the actuator unit have substantially the same shape as the pressure chambers.

24. An ink jet printer head as claimed in claim 18, wherein the actuator unit includes a piezoelectric material and electrodes for applying voltage to the piezoelectric material, each of the pressure generating portions of the actuator unit being formed by at least the projected form of the corresponding electrode on the piezoelectric material.

* * * * *